US006415568B1

(12) United States Patent
Lingenfelder et al.

(10) Patent No.: US 6,415,568 B1
(45) Date of Patent: Jul. 9, 2002

(54) PARTITION, IN PARTICULAR FOR EXHIBITION AND SHOW STANDS

(75) Inventors: Wolfgang Lingenfelder, Höchberg; Hans-Jürgen Meyer, Würzburg, both of (DE)

(73) Assignee: Mero Systeme GmbH & Co. KG (DE)

( * ) Notice: Subject to any disclaimer, the term of this patent is extended or adjusted under 35 U.S.C. 154(b) by 0 days.

(21) Appl. No.: 09/485,255

(22) PCT Filed: Jul. 25, 1998

(86) PCT No.: PCT/DE98/02099

§ 371 (c)(1),
(2), (4) Date: Feb. 3, 2000

(87) PCT Pub. No.: WO99/07957

PCT Pub. Date: Feb. 18, 1999

(30) Foreign Application Priority Data

Aug. 6, 1997 (DE) ..... 197 33 923

(51) Int. Cl.[7] ..... E04H 1/00

(52) U.S. Cl. ..... 52/240; 52/241; 52/481.2; 52/584.1

(58) Field of Search ..... 52/239–242, 235, 52/584.1, 480, 481.1, 481.2

(56) References Cited

U.S. PATENT DOCUMENTS 3,915,579 A * 10/1975 Offenbroich ..... 403/264
4,471,548 A * 9/1984 Goudie ..... 52/646
5,038,535 A * 8/1991 Van Praag, III ..... 52/285
5,179,810 A * 1/1993 Gename et al. ..... 52/769
5,211,502 A * 5/1993 Upham-Hill ..... 403/353
5,421,112 A * 6/1995 Knorr ..... 40/600
5,430,984 A * 7/1995 Young et al. ..... 52/239
5,694,729 A * 12/1997 Blackburn et al. ..... 52/582.2

* cited by examiner

*Primary Examiner*—Carl D. Friedman
*Assistant Examiner*—Yvonne M. Horton
(74) *Attorney, Agent, or Firm*—McGlew and Tuttle, P.C.

(57) ABSTRACT

Partitions are provided, in particular for exhibition or show stands. These partitions can be assembled from a plurality of inherently rigid wall elements, which are each essentially formed from a frame and at least two panel plates covering the frame on the outside. The individual wall elements are releasably connectable to one another by coupling members. Each coupling member is essentially constructed from three partial elements, namely two frame connections (7, 49) and a connecting element (8, 46). The two frame connections are arranged in each case in the region of the outside of the vertical frame limbs (6) of two wall elements which are to be connected. The frame connections (7, 49) and the connecting element (8, 46) can engage behind one another in a clamping fashion. In this manner, individual wall elements can be removed from an already assembled partition by the controlled removal of individual connecting elements.

22 Claims, 18 Drawing Sheets

PARTITION, IN PARTICULAR FOR EXHIBITION AND SHOW STANDS

FIELD OF THE INVENTION

The invention relates to a partition, in particular for exhibition and show stands, which can be constructed from a plurality of inherently rigid wall elements. The wall elements are formed by a frame, which essentially produces the mechanical strength, and two panel plates covering the frame on the outside. The individual wall elements are detachably connectable to one another by means of coupling members, so that the various partition geometries can be constructed from individual wall elements.

BACKGROUND OF THE INVENTION

Partition systems of the above type having self-supporting wall elements are known. A partition system is described in EP 0 455 656 B1, whose individual wall elements each comprise locking recesses on one vertical side and coupling journals on the opposite vertical side of a wall element which is to be connected. If a partition is to be constructed from these wall elements, it is necessary to suspend the individual wall elements with their coupling journals in the locking recesses of the subsequent wall element in each case. As a result a securely joined partition construction is produced from the individual wall elements. A disadvantage of this partition system is that following construction of the partition wall it is only possible to remove the last wall element suspended in the partition construction. Wall elements which are fitted between two other wall elements can only be removed with a great deal of effort. If the partition geometry is to be altered or extended following construction of one part of the partition as a result it is necessary to dismantle all the wall elements and to reconstruct the partition from the beginning.

SUMMARY AND OBJECTS OF THE INVENTION

It is the object of the invention to provide a partition of the initial described type in which the individual wall elements can be simply dismantled from an already erected partition construction.

According to the invention, Exhibition/show stand partitions are provided comprising a plurality of inherently rigid wall elements. Each wall element includes a frame with vertical frame limbs and at least two panel plates covering the frame and defining an outside. Coupling members are also provided. The individual wall elements are releasably connectable to one another by a corresponding coupling member. Each coupling member includes three partial elements comprising two frame connections and a connecting element. Each of the frame connections is arranged in each case in a region outside of the vertical frame limbs of two wall elements which are to be connected. The frame connections and the connecting elements comprise matching operating surfaces, providing clamping engagement behind the operating surfaces on the frame connections.

The individual wall elements of the partition according to the invention are connected to one another by means of three-part coupling members. Each coupling member comprises two frame connections, which are fixedly, more particularly integrally, connected to the vertical frame limbs of the wall elements on the outside thereof, and a connecting element in each case. The frame connections and the connecting element comprise matching operating surfaces, which allow the operating surfaces on the connecting element to engage in a clamping manner behind the operating surfaces on the frame connections. If two wall elements are to be connected to one another, these elements are positioned next to one another on the floor laterally offset relative to one another and the vertical lateral surfaces of the frames are aligned until two frame connections which are to be connected lie directly opposite one another. In this position, a connecting element can be fitted onto two oppositely disposed frame connections in each case. The number of coupling members by means of which two wall elements are connected in each case is of no consequence according to the invention. However, in order to ensure the required rigidity of the partition, two wall elements should be connected to one another using at least two coupling members in each case. If a single partition element is to be removed from the partition construction, it is merely necessary to release the connecting elements of the coupling members in question, and the wall element is then lifted out of the construction.

The assembly of the partition wall elements can be effected in a particularly simple manner if the frame connections are arranged fitted on the vertical outer edges of the wall elements. This arrangement produces a horizontal spacing between the individual wall elements, so that the frame connections are easily accessible during assembly. The horizontal intermediate space between the wall elements allows for simple assembly and dismantling of the connecting elements. In addition, the fitted arrangement of the frame connections allows for the formation of the frame from four simple profile sections, which are connected to one another at the corners and on whose outer side the frame connections are arranged. In this respect, all types of frame constructions are possible in principle. However, it is particularly expedient to construct the frame limbs from hollow profile elements and to provide a frame connection in the region of the corners in each case. In this respect, it is possible to connect the individual hollow profiles by means of inserted corner elements, a frame connection being arranged on the corner elements in each case. Thus, it is possible to manufacture wall elements of any size by simply varying the length of the hollow profile elements whilst using the same corner elements at all times.

The required matching operating surfaces on the frame connections and on the connecting element can be manufactured in a particularly simple manner in that the frame connection is constructed as a bolt-like molded element with engageable clamping surfaces and the connecting element is constructed as an open hollow cube. The connecting bolt can then engage behind the lateral walls of the connecting element, and the cube walling is clamped between the lateral outer wall of the vertical frame limb and the clamping surface of the connecting bolt.

In order to obtain a bearing surface between the bolt and hollow cube which is as large as possible, the hollow cube can comprise recesses in its lateral surfaces, which recesses open towards the open side of the hollow cube and can be penetrated by the projection of the frame connection. The clamping surface of the bolt comes to rest against the inside of the hollow cube in the peripheral region of the grooves. Once a hollow cube is fitted on a connecting bolt, it can be pushed onto the bolt until the end of the recess comes to abut against the bolt projection.

In order to prevent a tilting of a connecting element constructed as a hollow cube, the cube is provided on one side face with a tongue, which can engage in a groove in the vertical frame limbs. A hollow cube can then be fitted from the side onto a connecting bolt and is then pivoted about the axis of symmetry of the connecting bolt into the end position, the tongue engaging in the groove.

According to the invention, it is not only possible to connect two, but also three, four, five, six or more wall elements to one another at one point by using rigid connecting elements. To this end, it is necessary to use connecting elements which comprise a corresponding number of operating surfaces for connecting the respective wall elements. For example, four wall elements can be connected using one connecting cube which is open on one side and in which all four lateral surfaces are designed for connection with the frame connections. Connecting elements of this type are particularly advantageous, since it is hereby possible to extend already constructed wall structures in a simple manner by the suspension of further wall elements.

As a result of the horizontal spacing of the individual wall elements it is not only possible to connect a plurality of wall elements to one another at one point. With a corresponding design of the geometry of the connecting element, it is also possible for two or more connected wall elements to form a connecting angle of 45°, 90°, 135°, 180° or another preselected number of degrees In this respect, connecting elements are also conceivable in which the operating surfaces can be adjusted relative to one another, so that any desired connecting angle can be produced.

Since partitions should have a substantially continuous wall surface following assembly, it is advantageous according to the invention to provide cover elements, which can be fixed in the horizontal intermediate spaces between the individual wall elements substantially planeparallel to the wall surface of the partition wall. Following assembly of the wall elements, the cover elements are fitted into the intermediate spaces so that a continuous wall surface is obtained.

In principle, there are many possibilities for connecting the cover elements to the partition. For example, the cover elements can be securely screwed to the partition or clipped into place. The assembly and dismantling of the cover elements is particularly simple and quick if the cover elements are releasably connected to the partition by means of magnetic connecting members. If a higher degree of strength of the connection between the cover elements and the partition is required, then the cover elements should comprise positive-locking connecting members, which can be inserted into the partition.

According to the invention, it is preferable to provide functional elements on the cover elements, which allow for the attachment of shelfbase supports, tables or the like, for example, to the outside of the partition, so that the interior of an exhibition stand, for example, can be easily constructed.

In addition to the possibility of fitting the frame connections to the vertical outer edges of the wall elements, as described above, it is equally possible according to the invention to integrate the frame connections in the vertical outer edges of the wall elements. As a result, the frame connections do not project laterally from the wall elements. In a manner known per se, it is thereby directly possible to construct partitions having a continuous wall surface without intermediate spaces. The subsequent fitting of cover elements in the intermediate spaces can thus be dispensed with. In partition systems of this type, the frame connections of the coupling member are preferably manufactured in that the frame is essentially constructed from hollow profile elements and the open profile cross sections at the end of the vertical frame limbs are used as frame connections. A clamp-like connecting element can engage behind the lateral walls of the vertical frame limbs in order to connect two wall elements. To this end, it is necessary to push the connecting element onto the vertical frame limbs from above or from below.

However, if only one clamp-like connecting element is fitted onto the ends of two oppositely disposed vertical frame limbs, then a lateral offset of the individual wall elements cannot be ruled out, resulting in a ridge in the surface of the partition. In order to rule out a lateral offset of this type between the partitions, it is advantageous to construct the frame connections as recesses in the outer walling of the vertical frame limbs, which recesses open towards the end of the vertical frame limb.

The connecting element is then no longer constructed in the manner of a clamp, but as a prismatic, rod-like element, duct-like clamping grooves being arranged in the lateral surfaces. In order to connect two wall elements, the recesses in the oppositely disposed vertical limb profiles are aligned with their surfaces congruent and the connecting element is then pushed simultaneously into both recesses from above. The clamping grooves in the connecting element thereby engage around the walling of the two oppositely disposed vertical limb profiles and thus connect the two wall elements.

In order to connect two wall elements, it is sufficient for the connecting bolt to comprise two clamping grooves. However, the fitting of the connecting bolts is considerably facilitated if four clamping grooves are provided in the connecting bolt and are arranged mirror-symmetrical to the vertical body axis. During the fitting of the connecting bolts, the latter can then be fitted into two body orientations of equal value in respect of function. These two fitting positions can be easily found by touch without direct visual contact of the connecting elements.

In order to facilitate, the fitting of the connecting bolts onto the vertical limb profiles, the clamping grooves of the connecting bolts should comprise centering surfaces on the end face. In order to prevent jamming of the connecting bolts, the end of the clamping groove should be relieved. In a particularly simple manner, a relief of the clamping groove can be produced by arranging a second groove in the connecting bolt. This second groove intersects the end of the clamping groove at an angle of approx. 900. The cross sectional surface of the vertical frame limb profile can then be brought into defined abutment against one lateral surface of the relief groove, so that a jamming of the connecting bolt on the vertical limb profiles is prevented.

Very generally speaking, it is possible to provide additional connecting members, for example threads, on the connecting elements, which allow for the attachment of function modules, in particular light emitters, to the partition.

In order to simplify dismantling of the connecting elements, dismantling tools should be provided, which can engage with operating surfaces in the connecting elements.

Since the coupling members are constructed in three parts and the connecting element is merely slipped onto the two frame connections, there is a danger of the connecting element accidentally releasing and the wall elements thereby being separated from one another. Securing elements should therefore be provided on the partition, which secure the position of the connecting elements in the fitted state. These securing elements can operate in a positive or force-locking manner upon the connecting elements, for example, and thus secure the position of the connecting elements on the frame connections.

In a particularly simple manner, the securing element can be constructed as a bolt, which can engage through matching recesses in the connecting elements and frame connections.

Equally, the securing element can be constructed as a spring-mounted locking bar. When the connecting element is pushed into position, the locking bar element snaps into position after reaching the end position without the intervention of the fitter. In order to release the connecting element, it is necessary to push back the locking bar against the spring force and then push back the connecting element. During the finishing of an exhibition stand, it is often necessary to lay power cables or data cables, and in exhibition stands having a roof construction or in two storey exhibition stands the securing of wall fixture elements, suspension cables and roof consoles is necessary.

In order to allow for the laying of cables and the fitting of additional components of this type, it is advantageous to construct the frame limbs, in particular the upper horizontal frame limbs, with a substantially U-shaped cross sectional region opening towards the outside. Cables can be laid and fixtures can be secured in this channel.

A light, but reinforcing honeycomb filling can be arranged in a manner known per se in the intermediate space between the covering panels. As a result of this honeycomb filling, the strength and torsional rigidity of the wall elements is increased, without significantly increasing the overall weight of the wall elements. A further plate of mechanically loadable material for anchoring retaining elements, such as screws or nails, can be arranged in a similarly known manner in the intermediate space between the covering panels. More particularly, this plate can be manufactured in a cost-effective manner from chipboard material.

It is usually necessary to carry out the construction of partitions, in particular for exhibition stands, within very short construction times. Consequently, the partitions should be composed of as few individual components as possible. A method for constructing partitions is therefore proposed, in which at least one connecting element is firstly pre-fitted on the frame connections on one vertical side of each individual wall element. This pre-fitting can be effected prior to the construction of the exhibition stand at the site of the construction company or manufacturers. During the construction of the partition in each case, one wall element with the pre-fitted connecting elements is then suspended in a second assembly step in the frame connections of another wall element on the vertical side without pre-fitted connecting elements. Finally, the remaining connecting elements are inserted and the partition is completed. As a result of the pre-fitting of the connecting elements, the required fitting of the connecting elements directly during the construction of the partition is avoided or reduced. If an individual wall element is to be dismantled, it is possible according to the invention to remove the respective connecting elements and to take out the relevant wall element.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
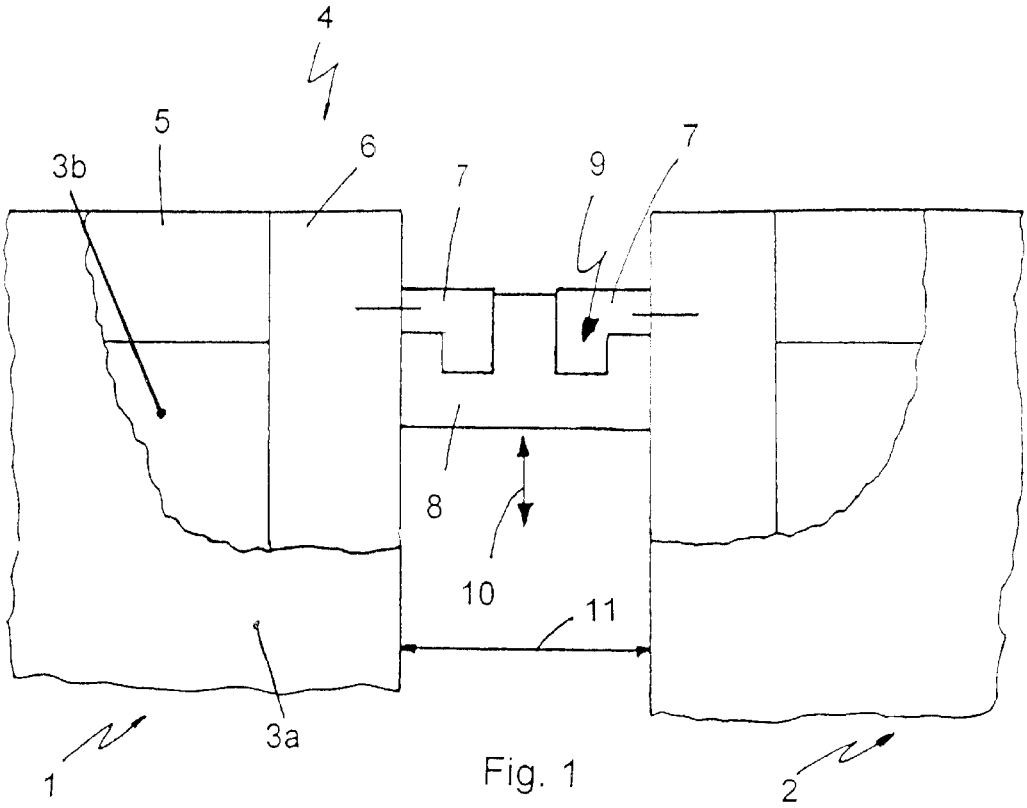
FIG. 1 is a schematic side view illustrating the operating principle of a partition according to the invention with frame connections fitted on the wall elements.
Figure 2:
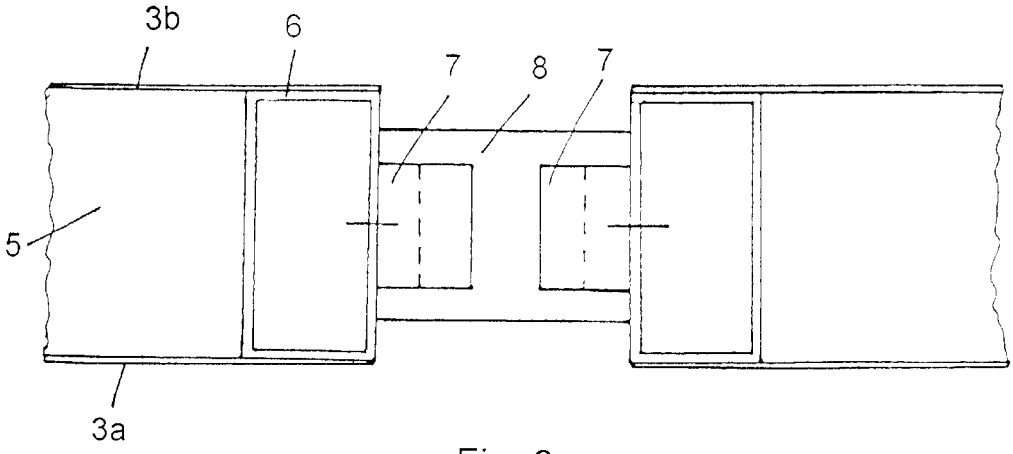
FIG. 2 is a schematic top view of the partition illustrated in FIG. 1.

Referring to the drawings in particular, FIG. 1 and FIG. 2 show the operating principle of a threepart coupling member for connecting wall elements with frame connections fitted on the wall elements. In this respect, the following are visible: The wall elements 1 and 2 shown in broken form, which are each constructed from the panels 3*a* and 3*b* and the frame 4. The frame is composed of the horizontal frame limbs 5 and the vertical frame limbs 6. The hook-like frame connections 7 are fitted onto the vertical outer edges of the wall elements and secured. The connecting element 8 comprises two U-shaped undercuts 9 and can be pushed onto the frame connections in a joining movement along the path of the movement arrow 10 or removed during dismantling. Following assembly of two wall elements, a partition section with a horizontal intermediate space 11 is formed.

Figure 3:
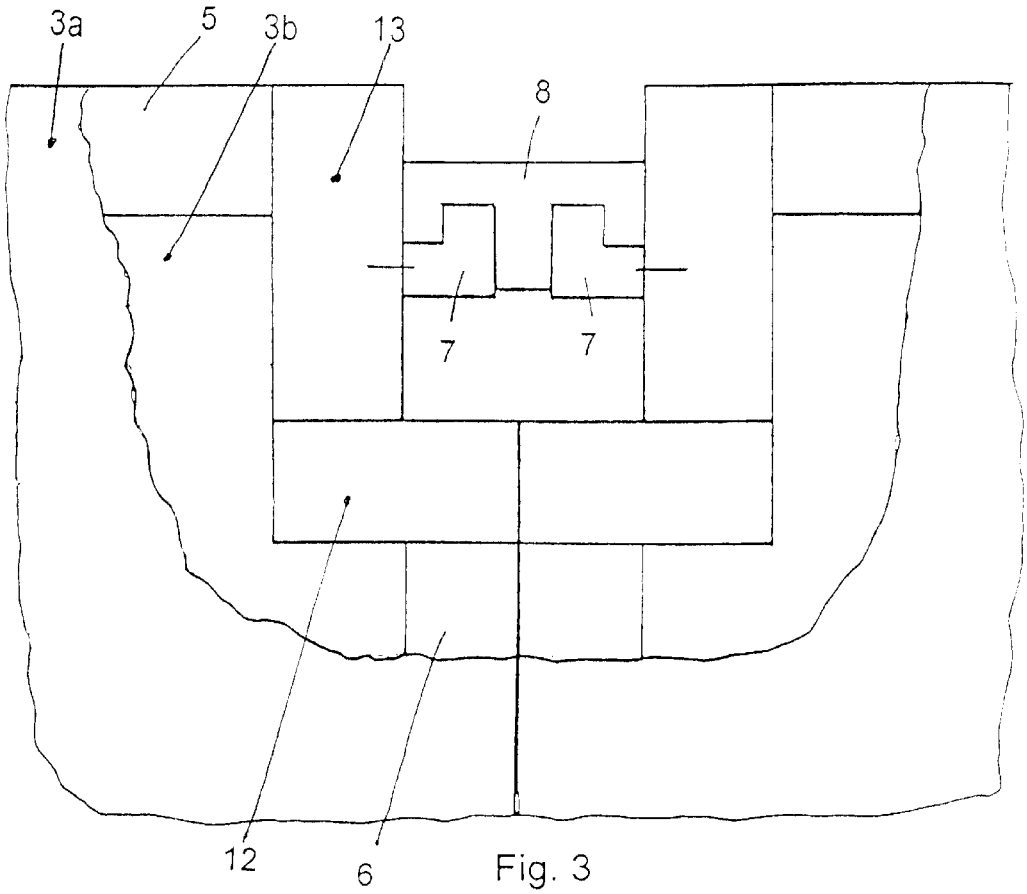
FIG. 3 is a schematic side view illustrating the operating principle of a partition according to the invention with frame connections integrated in the wall elements.
Figure 4:
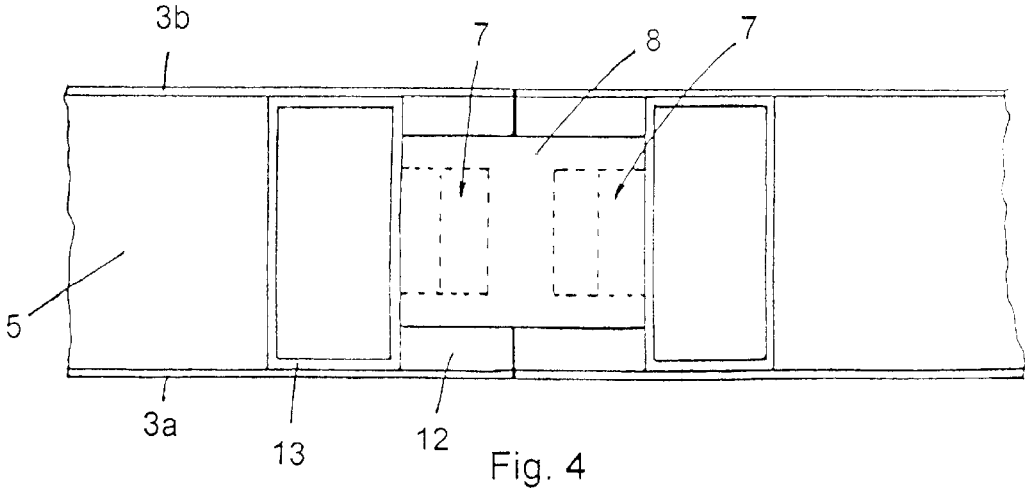
FIG. 4 is a schematic top view of the partition illustrated in FIG. 3.

FIG. 3 and FIG. 4 show the operating principle of a partition system according to the invention, in which the frame connections are arranged integrated in the vertical outer edges of the wall elements. Again visible are the panels 3*a* and 3*b,* the horizontal frame limb 5, the vertical frame limb 6 as well as the coupling member composed of the frame connections 7 and the connecting element 8. The corners of the outer contour of each wall element are provided with right-angled recesses, so that the frame connections can be arranged within the outer contour Consequently, two wall elements which are connected to one another abut against one another in the region of the vertical frame limbs, so that a continuous surface of the partition system is produced. This setting back of the frame connections can be attained, for example, by two additional frame sections 12 and 13, as illustrated in this case.

Figure 5:
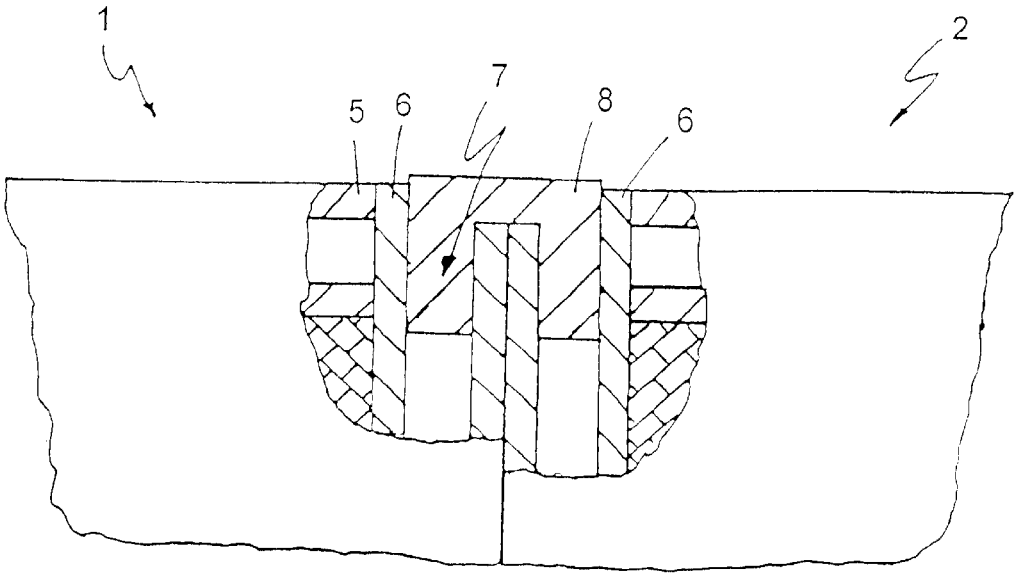
FIG. 5 is a schematic side view illustrating the operating principle of a partition according to the invention with frame connections integrated in the frame limbs.
Figure 6:
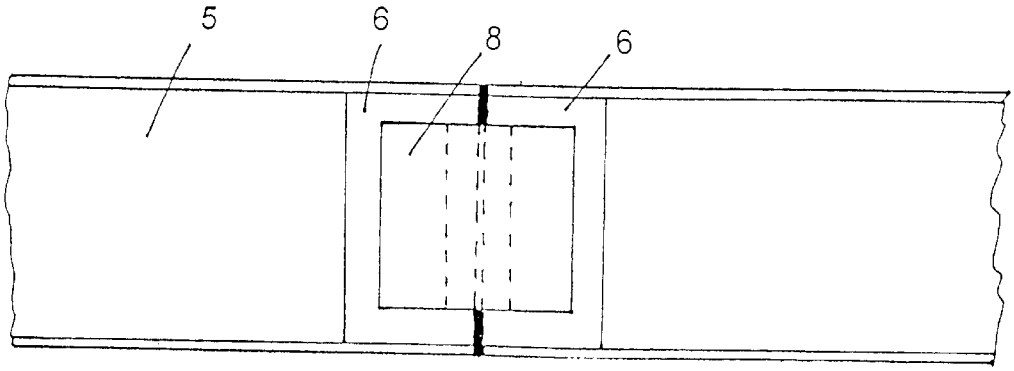
FIG. 6 is a schematic top view of the partition illustrated in FIG. 5.

FIG. 5 and FIG. 6 show the operating principle of a partition according to the invention, in which the frame connections of the coupling member are constructed as integral components of the vertical frame limbs. Hollow profiles, whose open profile cross section is used as the frame connection, are employed as vertical frame limbs. This is attained in that the connecting element is pushed in a clamping manner into the open profile cross sections at the ends of two vertical frame limbs 6 which are to be connected. The frame connections as separate components are thus dispensed with. In this manner, the construction of partition systems with a continuous surface is possible at minimal manufacturing cost.

Figure 7:
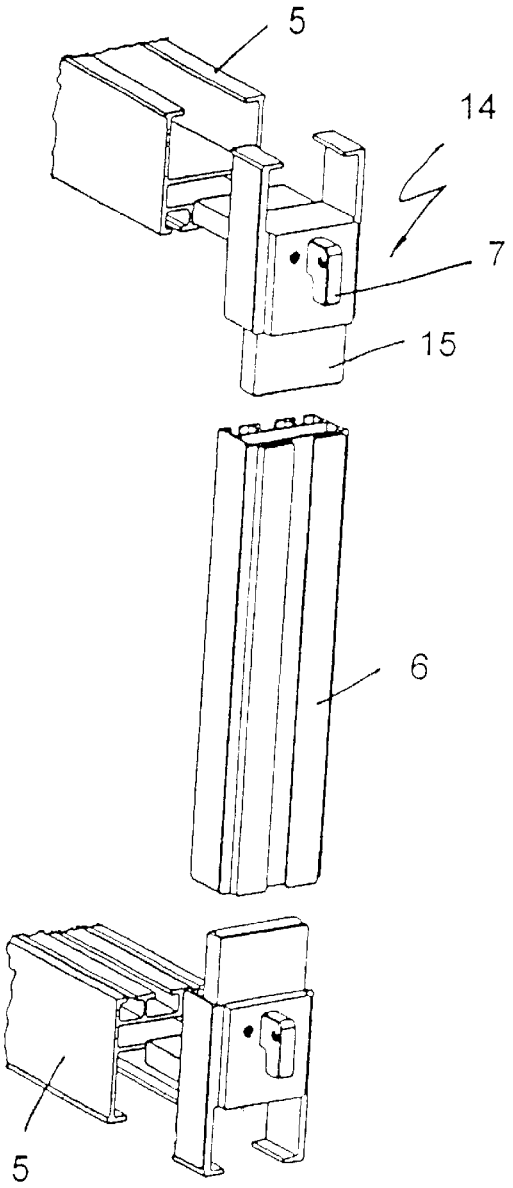
FIG. 7 is a perspective view of a section of a frame of a first embodiment of a partition according to the invention in the pre-assembled state.
Figure 8:
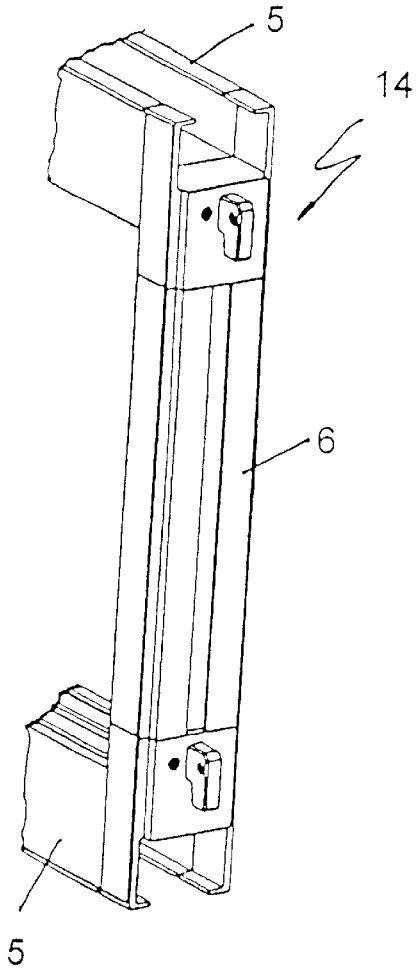
FIG. 8 shows the frame illustrated in FIG. 7 in the assembled state.

FIG. 7 and FIG. 8 show the frame construction of a first embodiment of a partition system according to the invention. Recognizable are the horizontal frame limbs 5 and a vertical frame limb 6. The different frame sections are connected to one another by means of the corner elements 14. The corner elements 14 comprise flange extensions 15, which can be pushed into matching regions of the profile cross sections. The hook-like frame connection 7 is integrally molded onto the corner element 14. Multifunctional corner elements of this type can be economically manufactured in all types of die casting or injection molding processes. The frame limbs comprise further profile sections, which on the one hand increase the strength of the frame limbs and on the other hand can fulfil further functions, such as the laying of cables or the attachment of fixtures.

Figure 9:
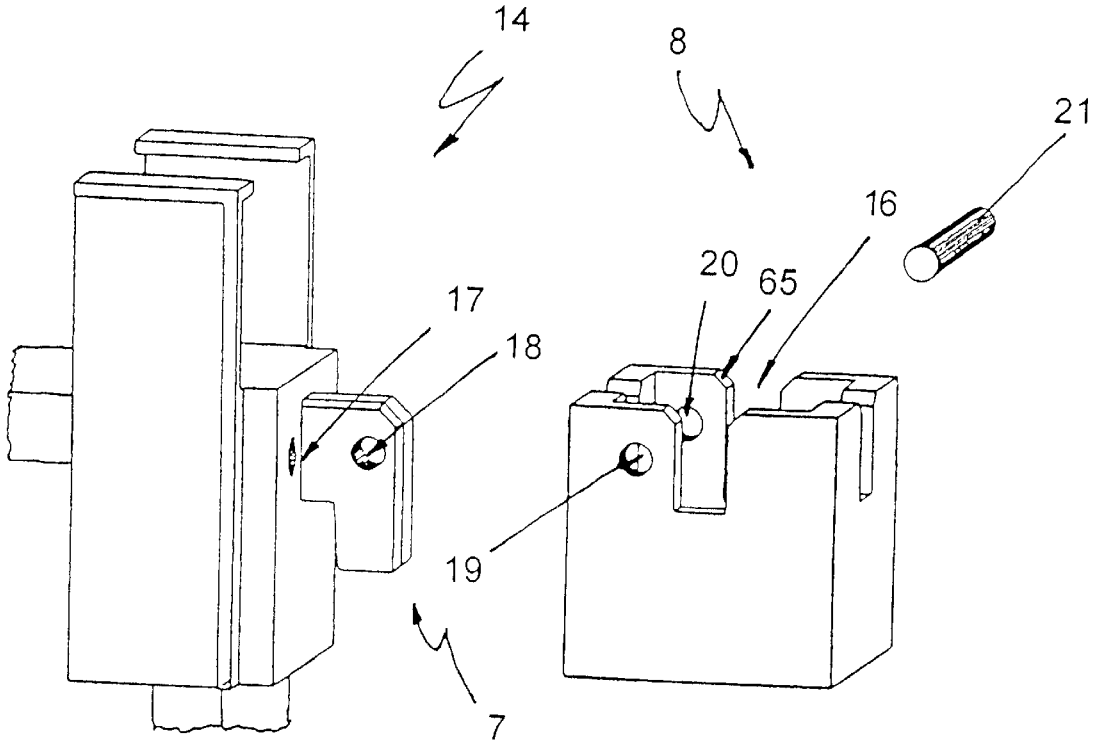
FIG. 9 is a perspective detailed view of the frame connection of the embodiment of a partition illustrated in FIG. 7 and the associated connecting element.
Figure 11:
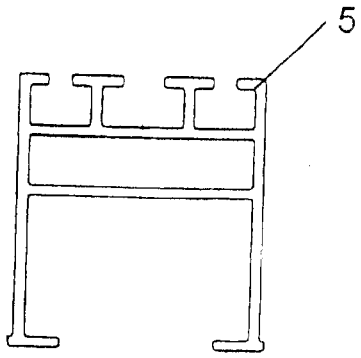
FIG. 11 shows the frame profile cross section used for the embodiment illustrated in FIG. 7.

FIG. 9 is a detailed view of the corner element 14 illustrated in FIG. 7 and FIG. 8 with the molded-on frame connection 7 and additionally shows the associated connecting element 8. The connecting element is constructed as a hollow cube, which is open on one side and behind which the hook-like frame connection 7 can engage on all four side walls. In this respect, the connecting element comprises recesses 16 in all four side walls, through which the projection 17 of the frame connection 7 can engage. In this manner, the lateral wall of the connecting element is clamped to the corner element by the hook-like frame connection, a tilting of the connection element being prevented by the abutment of the projection 17 against the lateral surfaces of the recess 16. The frame connection 7 and the connecting element 8 comprise matching bores 18, 19 and 20, into which a securing bolt 21 can be inserted. Once the securing bolt is fitted, accidental release of the connecting element is ruled out.

Figure 10:
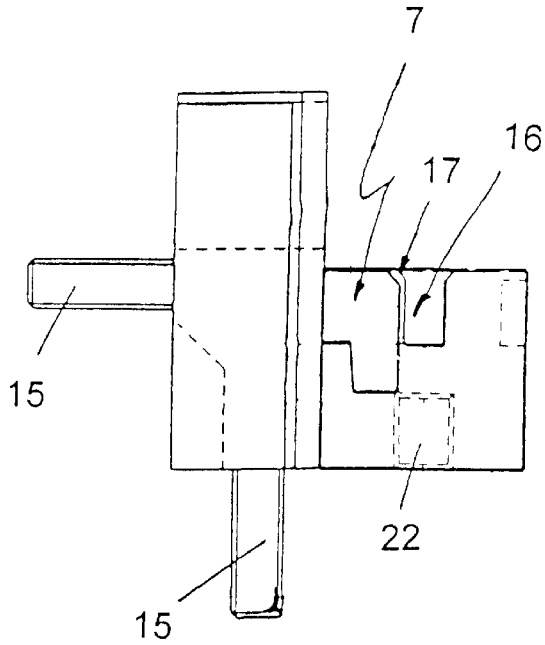
FIG. 10 is a side view of the frame connection and the connecting element of the embodiment illustrated in FIG. 7.
Figure 12:
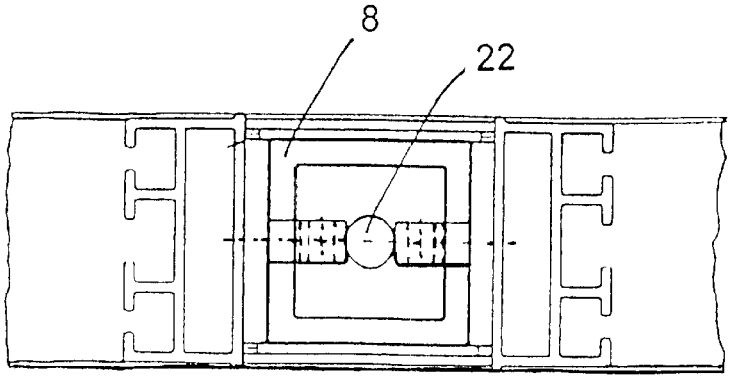
FIG. 12 is a top view of the connection of two wall elements with an embodiment illustrated in FIG. 7.

FIG. 10 shows the spacing bolt 22, whose upper end face comes to rest against the nose of the frame connection 7. As a result of the spacing bolt 22, the connecting element is prevented from being excessively pushed onto the frame connection. The recesses 16 comprise centering surfaces 65, which facilitate the pushing of the connecting element onto the frame connection 7.

Figure 13:
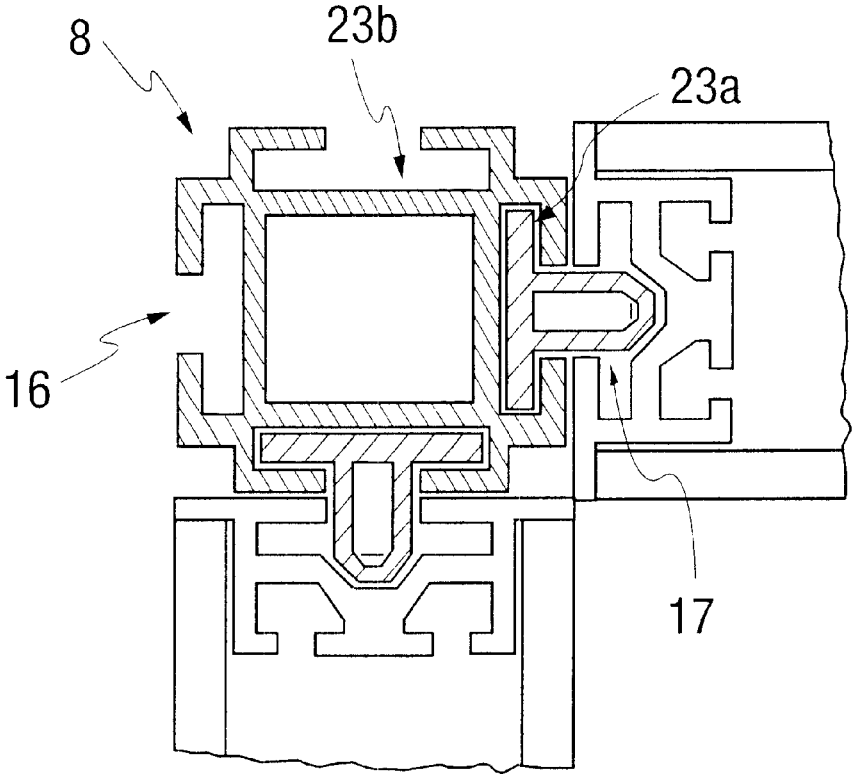
FIG. 13 is a top view of a connecting element for connecting up to four wall elements.

FIG. 13 shows a further embodiment of a connecting element 8 with four operating surfaces for connecting a maximum of four wall elements. Using connecting elements of this type, it is possible to realize corner connections or column structures. The frame connections 7 comprise a plate-like undercut 23*a,* which can be suspended in matching undercut contours 23*b* in the connecting element.

Figure 14:
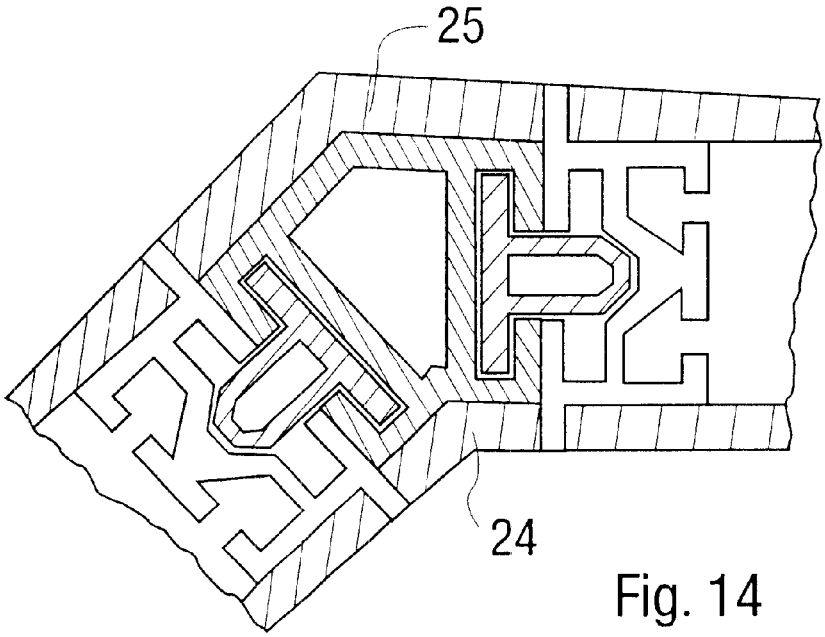
FIG. 14 is a top view of a connecting element for connecting two wall elements, forming a connection angle of 135°.

FIG. 14 shows a connecting element, in which the operating surfaces are inclined relative to one another in such a manner that the wall elements form a connecting angle with one another of 135°. According to the invention, it is equally possible to realize any other connecting angle. In each case, the operating surfaces of the connecting elements need to be correspondingly inclined relative to one another. In order to seal the intermediate space between the wall elements, cover elements 24 and 25 are secured between the wall elements.

Figure 15:
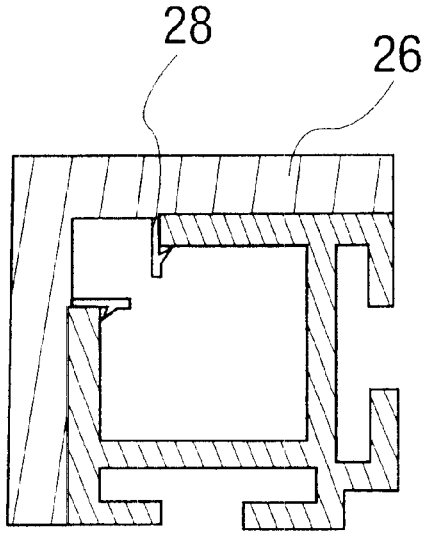
FIG. 15 is a top view of a cover element for covering a corner connecting element.
Figure 16:
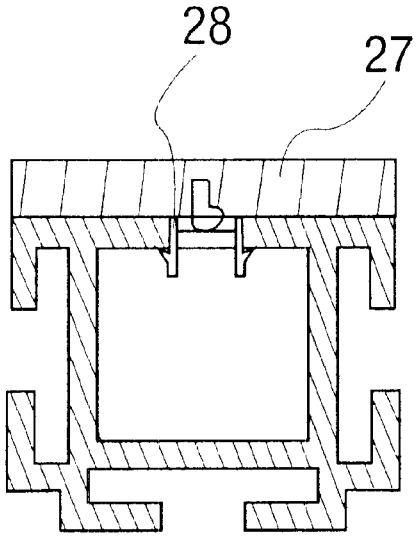
FIG. 16 is a top view of a cover element for covering a horizontal spacing between two wall element.

FIG. 15 and FIG. 16 show further embodiments of cover elements according to the invention. The cover elements 26 and 27 are clipped via the clip noses 28 into recesses in the connecting elements provided to this end.

Figure 17:
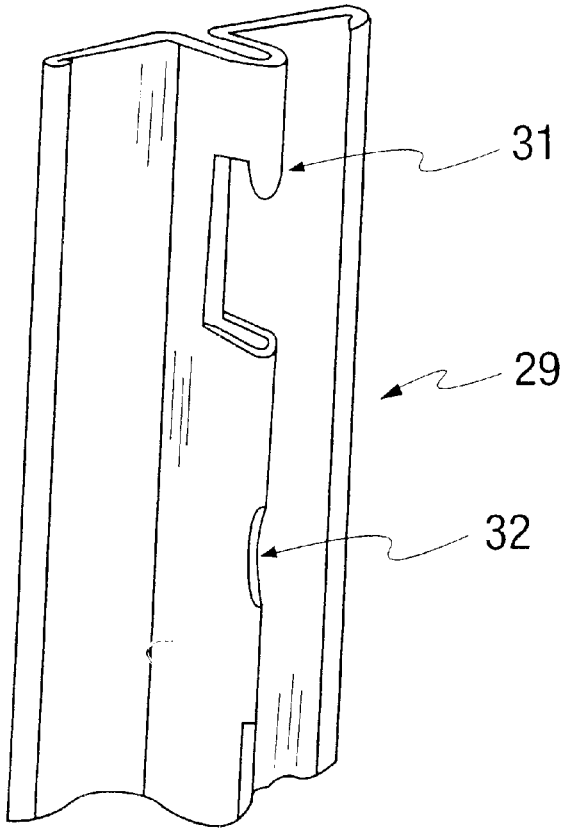
FIG. 17 is a perspective rear view of a further embodiment of a cover element to be suspended in the wall elements.
Figure 18:
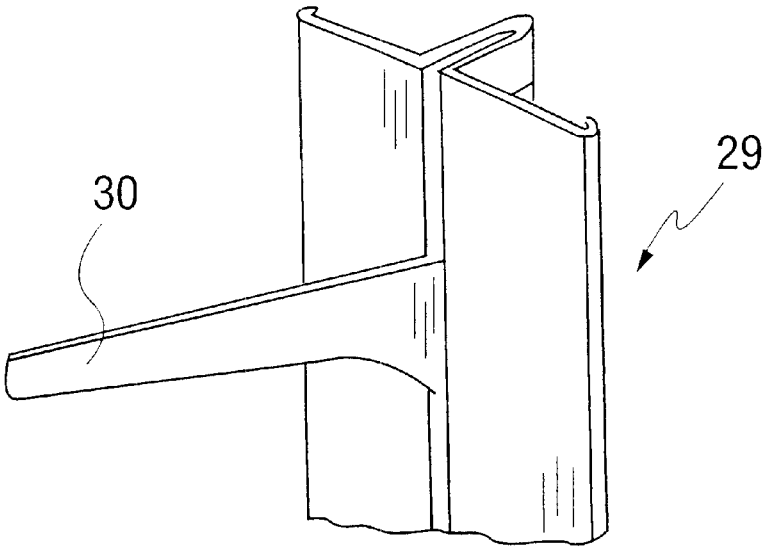
FIG. 18 is a perspective front view of the embodiment of a cover element illustrated in FIG. 17.

FIGS. 17 and 18 show a further embodiment 29 of a cover element. According to the invention, further functional elements, such as the shelf base support 30 illustrated in FIG. 18, can be secured to the cover element. In order to achieve adequate strength, cover strips of this type are preferably to be manufactured from sheet metal strips. These cover strips can then be suspended in the support wall by locking noses 31, for example, provided to this end. In order to secure the additional functional elements, the cover strip can-comprise recesses 32 at 35 different heights in a manner known per se.

Figure 19:
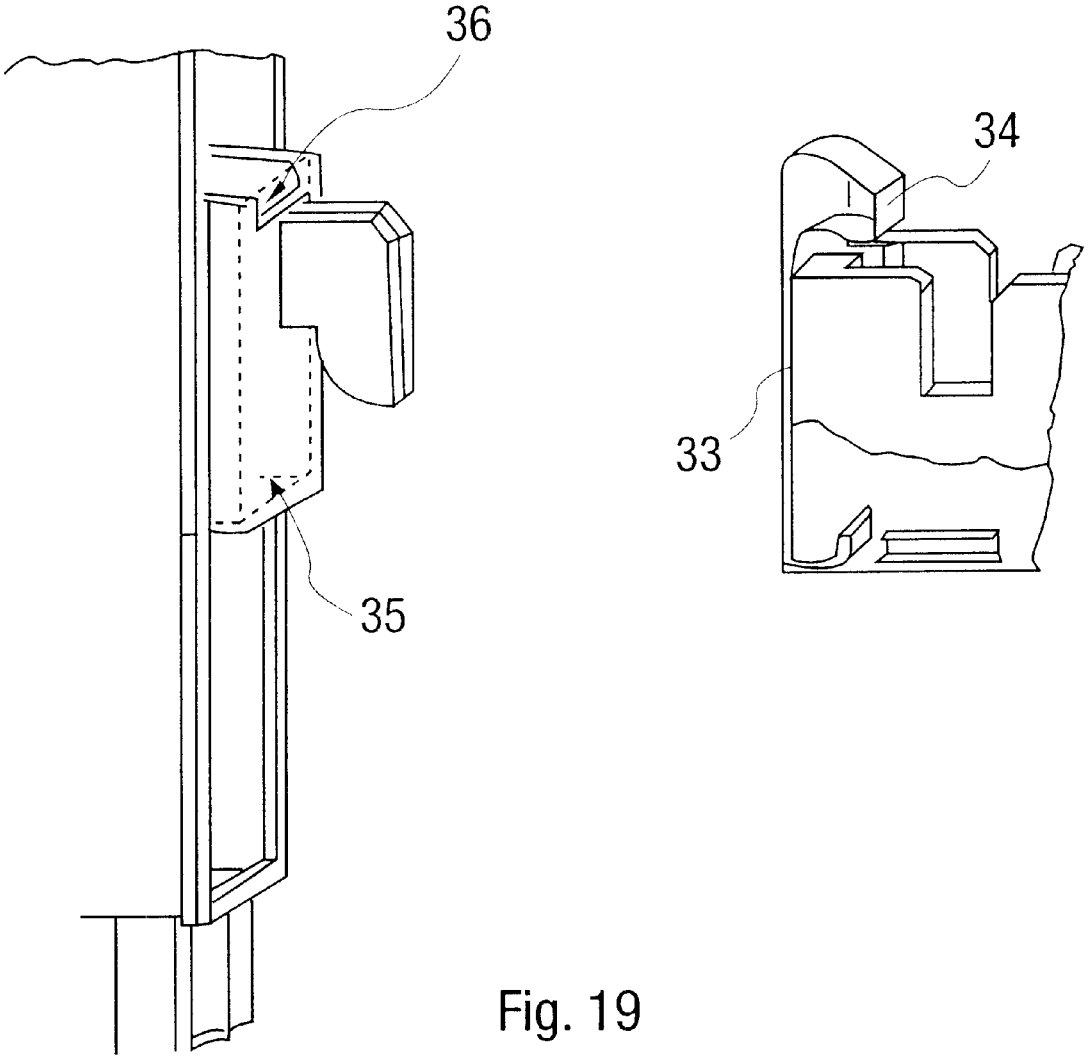
FIG. 19 shows a frame connection with associated connecting element and spring-mounted locking bar element arranged thereon.
Figure 20:
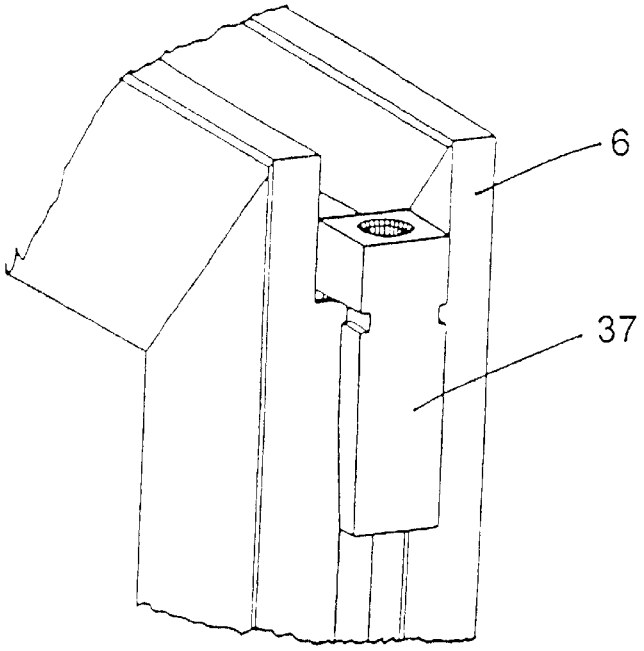
FIG. 20 is a perspective view of the coupling member of a second embodiment of a partition according to the invention.
Figure 21:
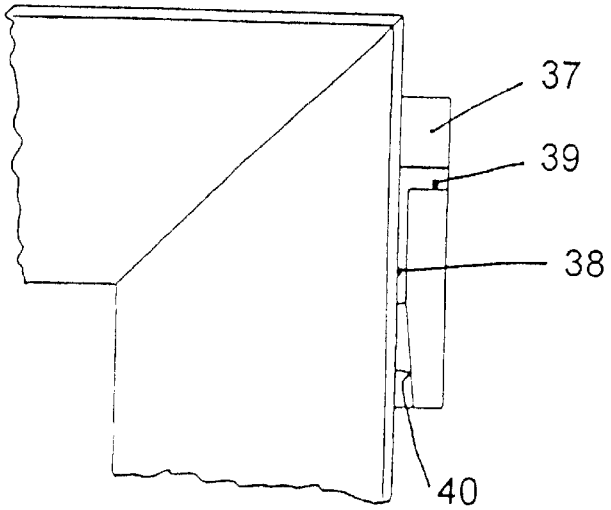
FIG. 21 is a side view of the embodiment illustrated in FIG. 20.

FIG. 19 illustrates a further possibility for securing the connecting element to the frame connections. The locking bar 34 mounted on the spring 33 engages through a hollow region 35 in the connecting element and locks into the locking contour 36. The connecting element can then only be released if the locking bar 34 is pushed backwards manually and the connecting element is removed in a downward direction. FIG. 20 to FIG. 29 show a second embodiment of a partition system according to the invention, whose frame connections are integrated in the profile cross sections of the vertical frame limbs. The connecting element constructed as a connecting bolt 37 is pushed into a recess in the open profile of the vertical frame limb 6. Recognizable in FIG. 21 is the clamping groove 38, which connects two frame profiles to one another, the relief groove 39, which prevents jamming of the connecting bolt, and the centering surfaces 40, which facilitate the joining of the connecting bolt.

Figure 22:
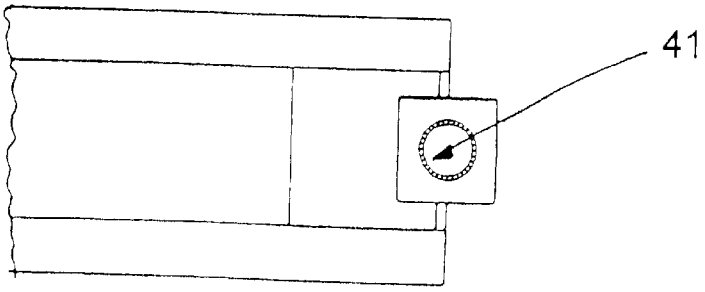
FIG. 22 is a top view of the embodiment illustrated in FIG. 20.

As illustrated in FIG. 22, the connecting bolt can comprise further functional elements, such as a thread 41 as shown in this case.

Figure 23:
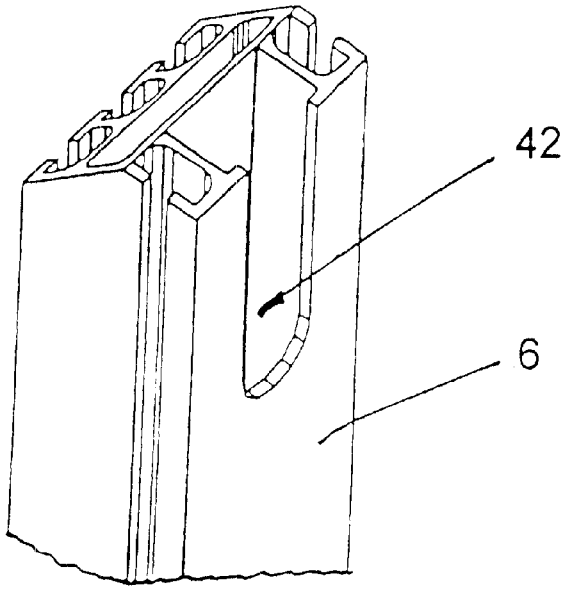
FIG. 23 is a perspective view of the end of the profile frame used as a frame connection for the embodiment illustrated in FIG. 20.
Figure 24:
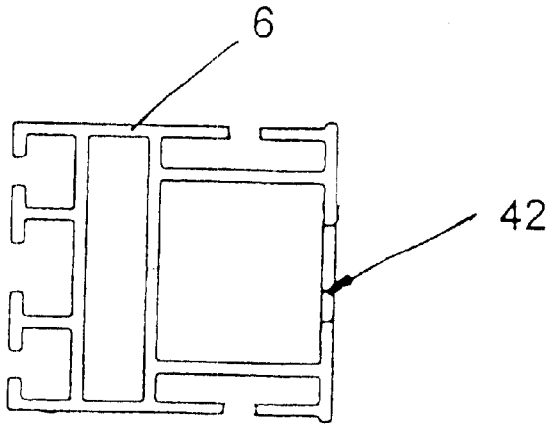
FIG. 24 is a top view of the profile frame illustrated in FIG. 23.
Figure 25:
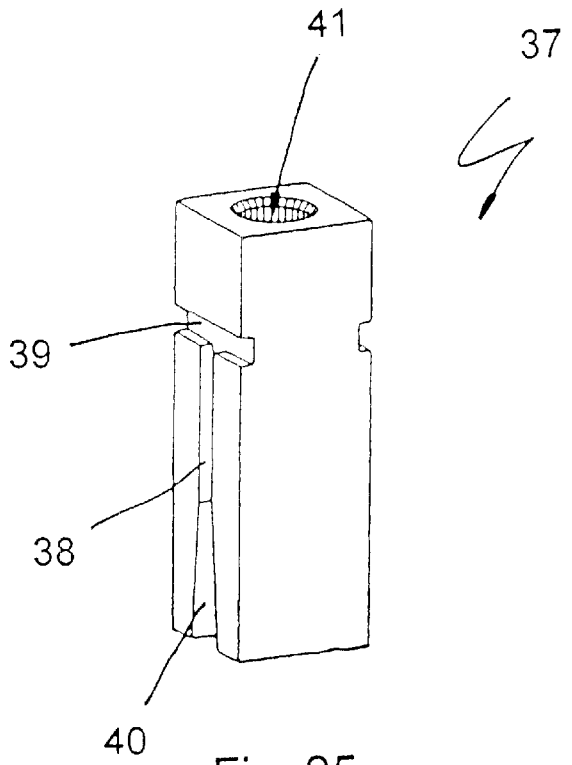
FIG. 25 a perspective view of the connecting bolt used in the embodiment illustrated in FIG. 20.
Figure 26:
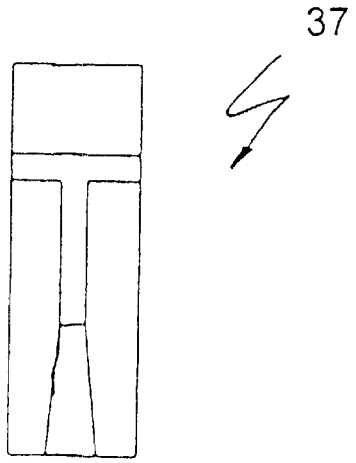
FIG. 26 is a side view of the connecting bolt illustrated in FIG. 25.
Figure 27:
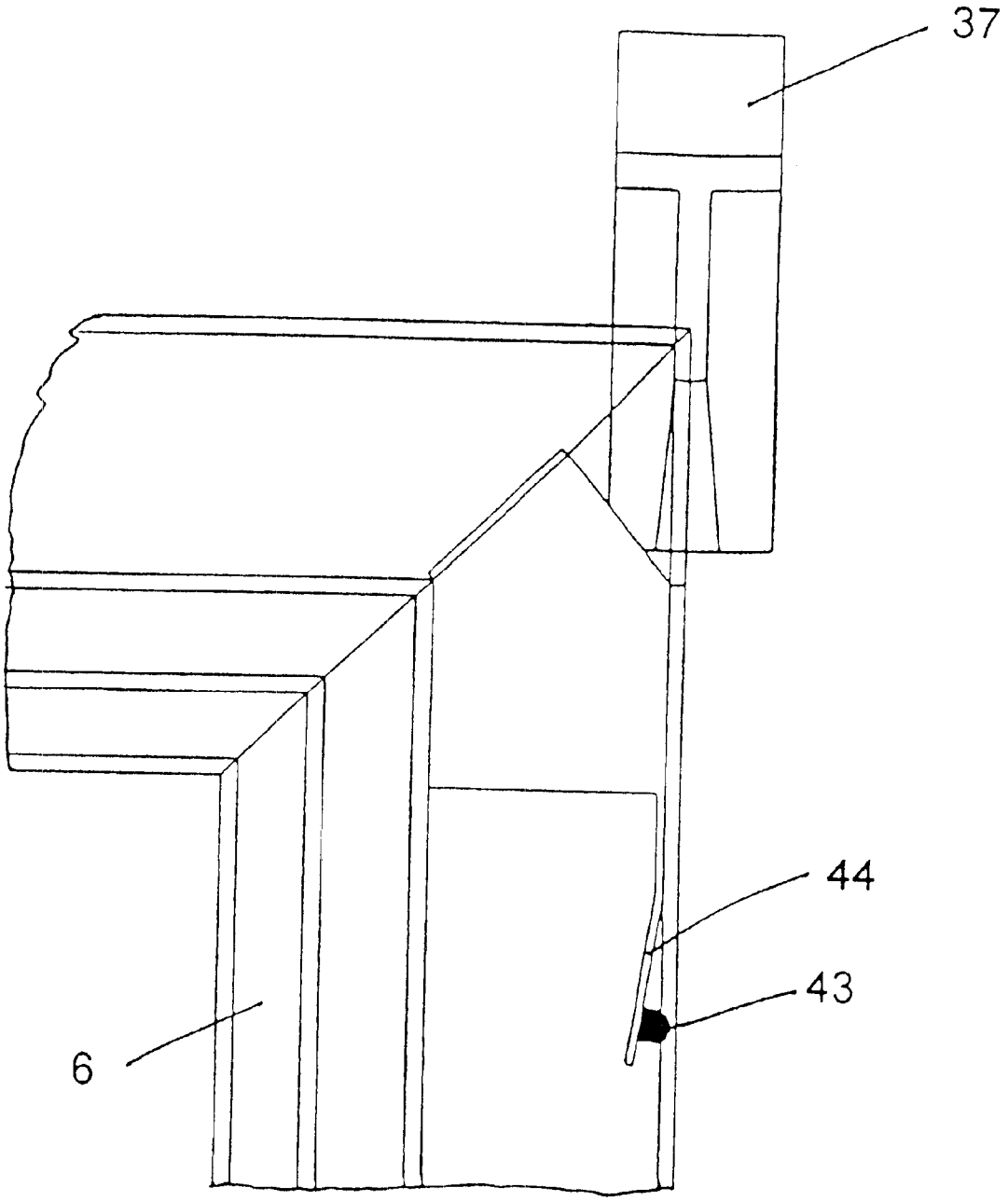
FIG. 27 is a side view of a spring-mounted securing bar for securing the embodiment of the connecting element illustrated in FIG. 20.

FIG. 23 shows the open profile at the end of the vertical frame limb 6, which comprises the recess 42 for receiving the connecting bolt 37. FIG. 27 illustrates the possibility of securing the position of a connecting bolt 37. The locking bar 43 is mounted on the spring 44 and in the end position of the connecting bolt 37 snaps into a matching recess or aperture in the connecting bolt. If the connecting bolt is to be released, it is necessary to push back the locking bar by hand and remove the connecting bolt in an upward direction.

Figure 28:
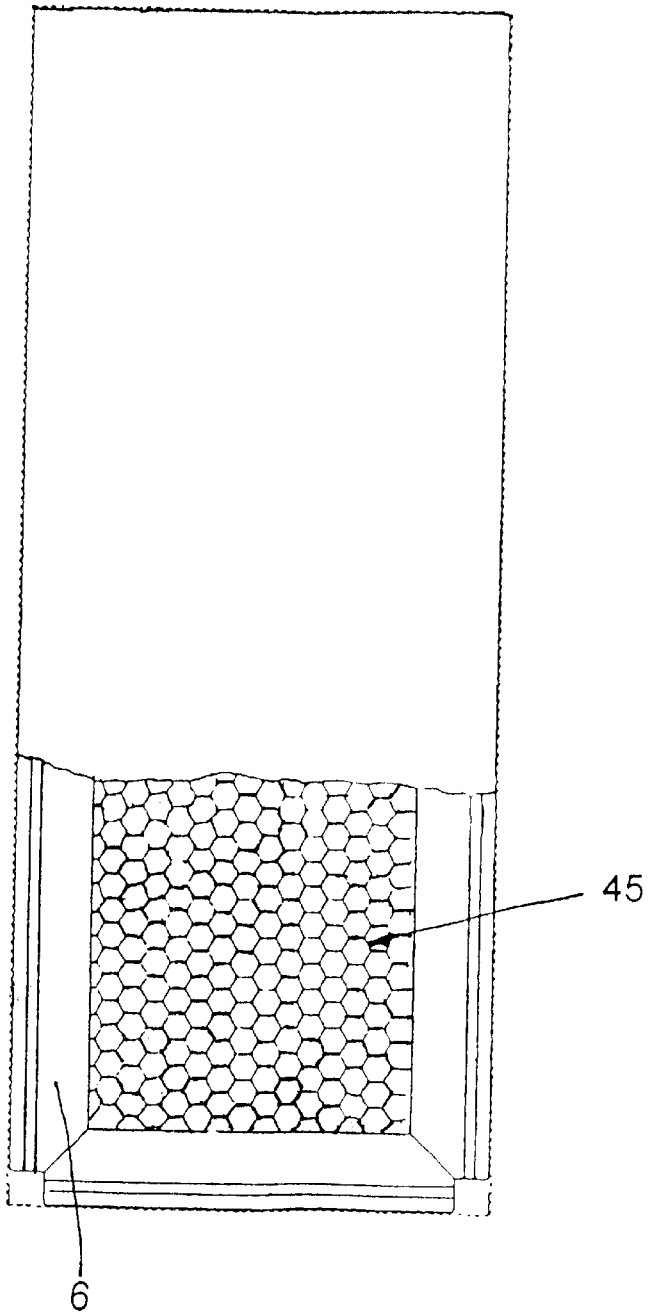
FIG. 28 is a front view of a complete wall element with four frame connections integrated in the wall element.
Figure 29:
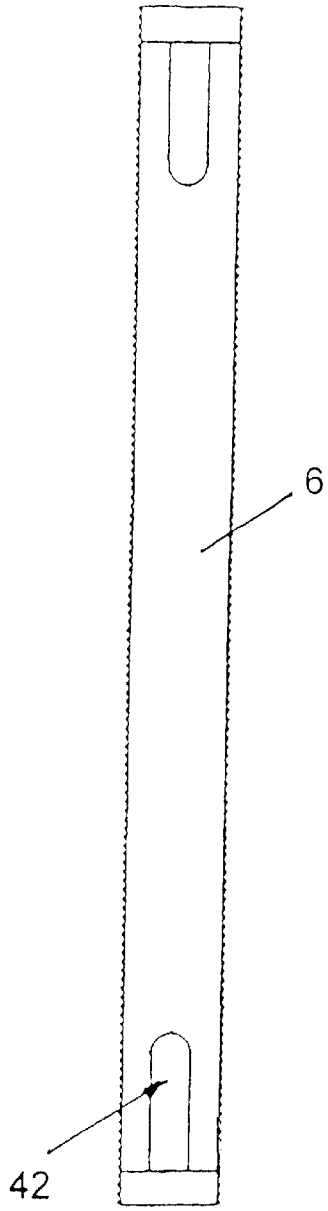
FIG. 29 is a side view of the wall element illustrated in FIG. 28.

FIG. 28 and FIG. 29 show a complete wall element with cover panels illustrated in broken form and four frame connections integrated in the frame limbs. Arranged between the cover panels and the frame is the honeycomb structure 45. This honeycomb structure increases the rigidity of the wall element without significantly increasing the weight.

Figure 30:
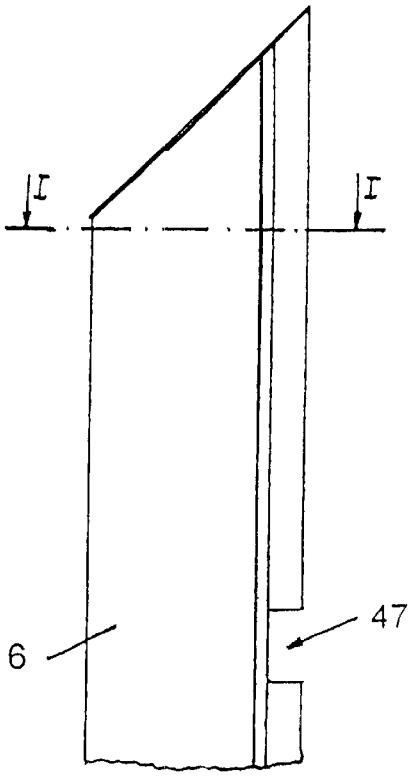
FIG. 30 is a side view of the vertical frame limb of a third embodiment of a partition according to the invention.
Figure 31:
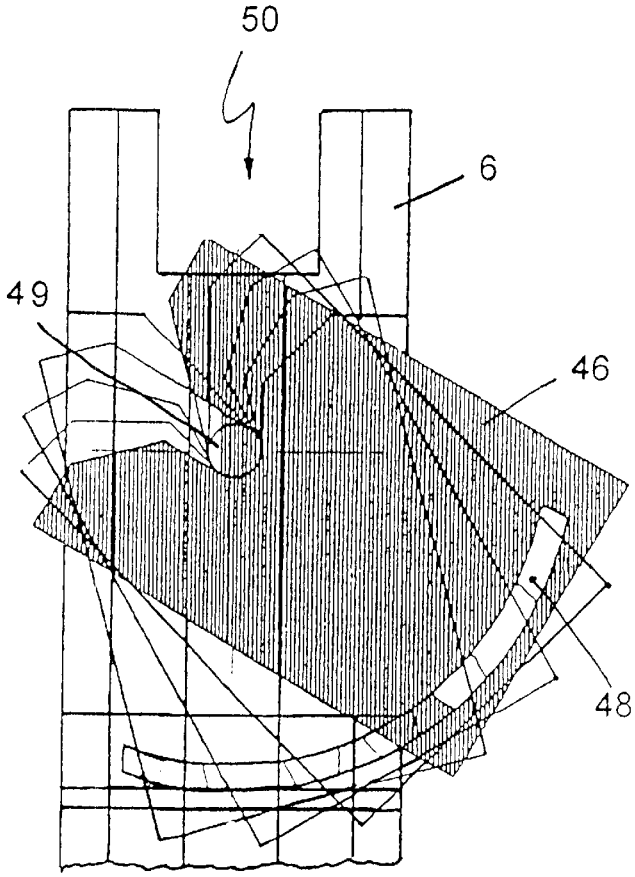
FIG. 31 is a front view of the vertical frame limb and the connecting element of the third embodiment of a partition according to the invention.

FIG. 30 shows a vertical frame limb 6 and the connecting element constructed as a hollow cube 46 of a third embodiment of a partition according to the invention. The connecting element can be brought into engagement via the securing tongue 48 in the groove 47. The joining movement required to this end is illustrated sequentially in FIG. 31. The hollow cube is fitted laterally on oppositely disposed frame connections constructed as retaining bolts 49 of two wall elements which are to be connected and is then pivoted about the retaining bolt into the vertical. During this movement, the securing tongue 48 slides in the groove 47. The groove illustrated in this case has horizontally extending lateral surfaces and is therefore simple to manufacture. An improved seat for the securing tongue can be attained if the groove is formed as a circular segment in the vertical frame limb matching the joining movement of the securing tongue. The U-shaped, open profile region 50, which extends in the upper edge of the wall elements, can be used for laying cables or for attaching further components.

Figure 32:
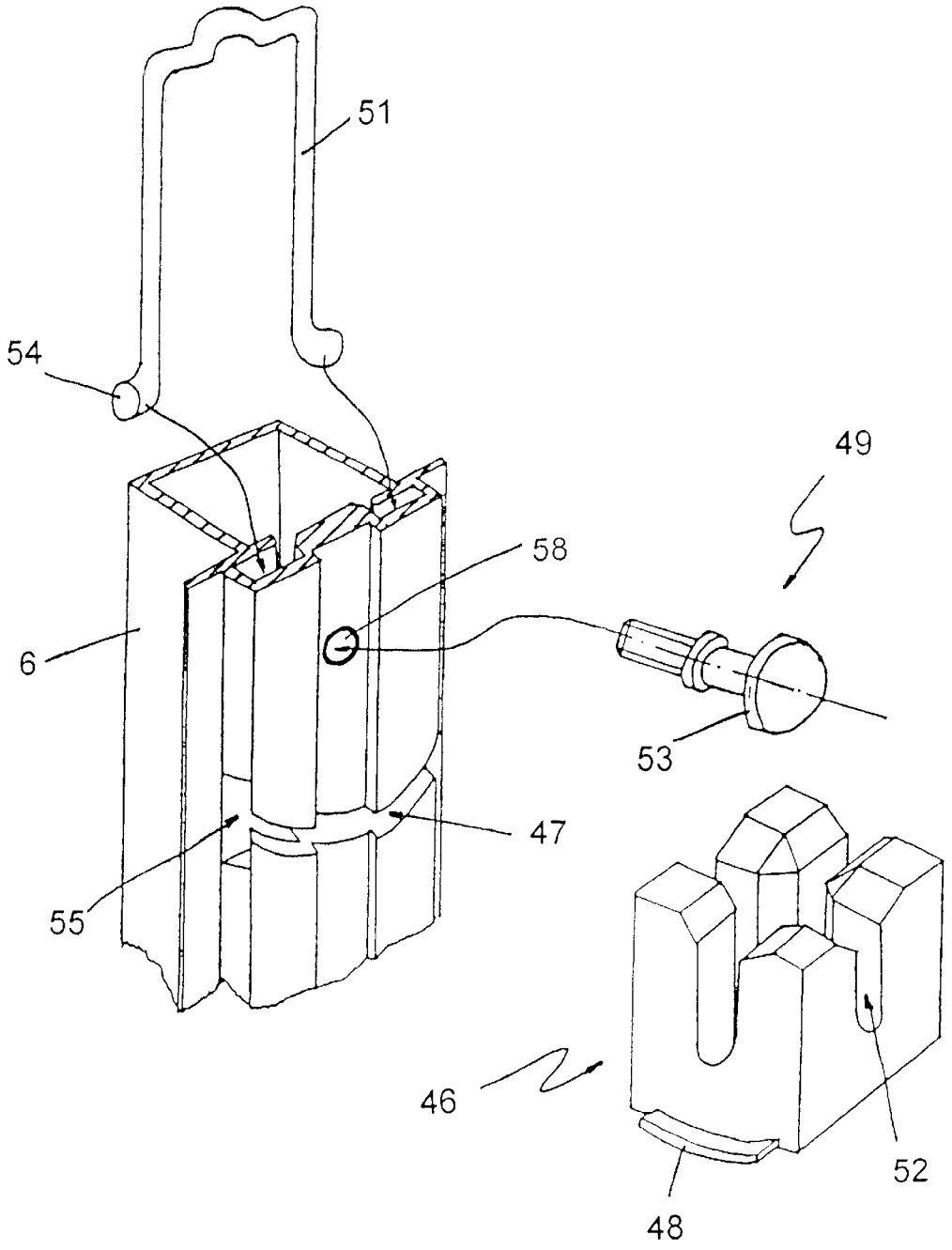
FIG. 32 is a perspective view of the vertical frame limb, the connecting element, the frame connection and the securing element of the third embodiment of a partition according to the invention.

FIG. 32 is a perspective view of the vertical frame limb 6, the connecting element 46, the frame connection 49 and the securing element 51 of the third embodiment of a partition according to the invention. In this case, the vertical frame limb is shown in section along the line I—I. Thus, the beveling of the vertical frame limb for connection with the horizontal frame limb is not shown. The retaining bolt 49 is screwed into the thread 58. The hollow cube 46 is then pushed with the recesses 52 onto the retaining bolt 49, the retaining bolt engaging through the recess and the head 53 of the retaining bolt engaging behind the walling of the hollow cube. The hollow cube 46 is then pivoted into the vertical, the tongue 48 engaging in the groove 47, which has the shape of a circular segment in this case.

The securing element 51 is provided to prevent accidental release of the hollow cube 46. The securing element 51 is introduced into the open profile of the vertical frame limb from above and can engage with the displayed bracket ends 54 through the vertical frame limb 6 in the vertically extending grooves 55. These grooves extend in each case a short distance upwards and downwards at the end of the groove 47. The securing bracket can therefore adopt two positions in the fitted state. If the bracket is pushed upwards, the securing tongue 48 can be introduced into the groove 47 and can also slide out of the groove. This position of the securing bracket thus allows for fitting and dismantling of the connecting elements. If two wall elements are connected to one another by securing the hollow cube, then the securing bracket slides into the lower position under the influence of gravity or with the intervention of a fitter. In this manner, the securing tongue 48 is prevented from sliding out of the groove 47, since the bracket blocks the open groove end.

Figure 33:
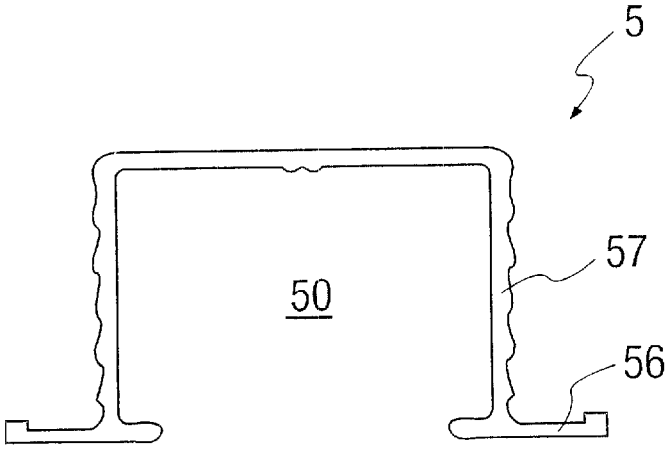
FIG. 33 is a cross section through the hollow profile of the horizontal frame limb of the third embodiment of a partition according to the invention.

FIG. 33 is a cross section through the hollow profile of the horizontal frame limb 5 of the third embodiment of a partition according to the invention. The panel plates, not shown, having a matching inner contour, can be brought to abut against the outer wall sections 56 and 57. The cross section of the horizontal frame limb corresponds to the cross section of the vertical frame limb to such an extent that the vertical frame limb can be transferred into the horizontal frame limb by the simple removal of a profile section. In this respect, the profiles are preferably to be manufactured from aluminum or another material having favorable extrusion properties.

Figure 34:
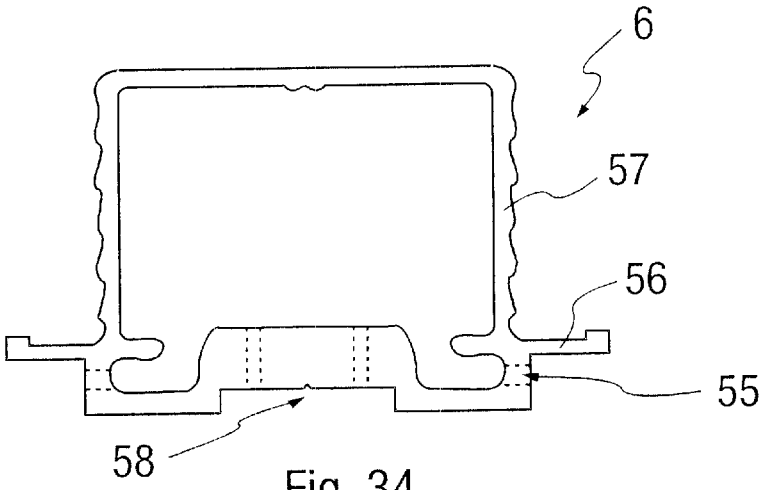
FIG. 34 is a cross section through the hollow profile of the vertical frame limb of the third embodiment of a partition according to the invention.

FIG. 34 is a cross section through the hollow profile of the vertical frame section of the third embodiment of a partition according to the invention. Recognizable are the non-visible vertical grooves 55 and the non-visible thread 58 for receiving the retaining bolt 49.

Figure 35:
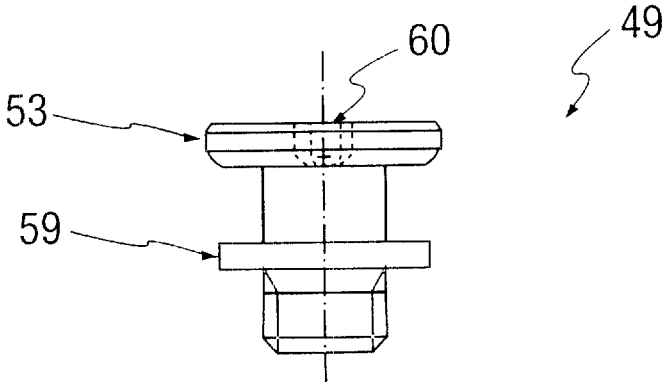
FIG. 35 is a side view of the frame connection constructed as a retaining bolt of the third embodiment of a partition according to the invention.

FIG. 35 is a side view of the frame connection constructed as a retaining bolt 49 of the third embodiment of a partition according to the invention. The bolt head 53 engages behind the recess in the connecting element 46. The circumferential bearing flange 59 ensures a defined position of the retaining bolt and allows for high screwing in forces. The retaining bolt 49 can be tightened by engaging a key in the polygonal recess 60.

While specific embodiments of the invention have been shown and described in detail to illustrate the application of the principles of the invention, it will be understood that the invention may be embodied otherwise without departing from such principles.

What is claimed is:

1. An exhibition/show stand partitions, comprising:

a plurality of inherently rigid wall elements, each wall element including a frame with vertical fame limbs and at least two panel plates covering the fame and defining an outside;

two frame connection coupling members, each of said frame connection coupling members being arranged in each case in a region extending, outwardly of an extent of said vertical frame limbs of the respective two connected wall elements; and a connecting element coupling member, said two frame connection coupling members and said connecting element coupling members respectively having matching operating surfaces, providing clamping engagement behind the operating surfaces, each of said frame connection coupling members being fitted on a vertical outer edge of the of a respective one of the wall elements, the two wall elements being connected to one another by engaging matching operating surfaces of said connecting element coupling member with each of said two frame connection coupling members whereby with a connecting angle of 180° a horizontal spacing is provided between wall elements, the spacing providing a gap between adjacent wall elements with the interior of the gap being accessible from one side of the connected wall elements.

2. The partitions according to claim 1, wherein said frame limbs are substantially constructed from hollow profile elements and each of said frame connection coupling members is arranged in a region of comers of said wall elements.

3. The partitions according to claim 1, wherein said connecting element further comprises a securing tongue, which are brought into engagement in a groove in said vertical frame limb.

4. The partitions according to claim 1, wherein each of said connecting elements include a plurality of operating surfaces for connecting two, three, four, five, six or more wall elements.

5. The partitions according to claim 1, wherein the operating surfaces are arranged relative to one another on said connecting element coupling members whereby the wall elements are connected to one another to form a connecting angle of one of 45°, 90°, 135°, 180°.

6. The partitions according to claim 1, further comprising cover elements, which are secured in vertically extending intermediate spaces between individual said wall elements substantially plane-parallel to wall surfaces.

7. The partitions according to claim 6, wherein said cover elements are detachably connected to via magnetic connecting members.

8. The partitions according to claim 6, wherein the cover elements are connectable via positive-locking connecting members, which can be inserted into the partition.

9. The partitions according to claim 6, wherein said cover elements comprise functional elements for the attachment of shelf base supports or tables to the outside of the partition.

10. The partitions according to claim 1, wherein said frame connection coupling members are constructed as recesses in an outer wall of said vertical frame limb, said recesses opening towards an end of said vertical frame limb, and clamping grooves with a duct shape, said clamping grooves being arranged in at least two lateral surfaces of a prismatic rod shaped said connecting element coupling member, said clamping grooves opening towards one end face of said connecting element coupling member and, by penetrating two said frame connection coupling members formed as recesses, being insertable into oppositely disposed vertical frame sections of two wall elements which are connected, the lateral surfaces of said grooves clamping outer walling of said vertical frame sections.

11. The partitions according to claim 10, wherein a connecting bolt is formed of four of said clamping grooves, preferably mirror-symmetrical to a vertical body axis.

12. The partitions according to claim 10, wherein said clamping grooves of said connecting bolt comprise centering surfaces on an end opening towards said end face and a further having a second groove extending perpendicular to a first groove and having substantially a same groove depth as said first groove arranged at an opposite, closed end of said clamping groove.

13. The partitions according to claim 1, wherein said connecting element coupling members further comprise threads for the attachment of modules.

14. The partitions according to one of claim 1, wherein said connecting element coupling members comprise operating surfaces for the engagement of dismantling tools.

15. The partitions according to claim 6, wherein further plates are arranged in an intermediate space between said cover elements, said further plates being formed of mechanically loadable chipboard material for anchoring retaining elements such as screws or nails.

16. An exhibition/show stand partitions, comprising:

a plurality of inherently rigid wall elements, each wall element including a frame with vertical frame limbs and at least two panel plates covering the frame and defining an outside;

two frame connection coupling members, each of said frame connection coupling members being arranged in each case in a region extending outwardly of an extent of said vertical frame limbs of the respecive connected two wall elements;

a connecting element coupling member, said two frame connection coupling members and said connecting element coupling members respectively having matching operating surfaces, providing clamping engagement behind the operating surfaces, each of said frame connection coupling members being fitted on a vertical outer edge of the of a respective one of the wall elements, the two wall elements being connected to one another by engaging matching opening surfaces of said connecting element coupling member with each of said two frame connection coupling members, wherein each of said frame connection coupling members is constructed as a molded bolt or hook element and said connecting element is a hollow cube open on one side, each of said frame connection coupling members engaging behind lateral walls of said hollow cube and the walling of said hollow cube being clamped between a lateral outer wall of one of said vertical frame limbs and an undercut of said connecting element.

17. The partitions according to claim 16, wherein each hollow cube comprises recesses with a recess in at least two lateral surfaces, said recesses extending continuously towards an open side of said hollow cube, said frame connection coupling members engaging behind said open side.

18. An exhibition/show stand partitions, comprising:

a plurality of inherently rigid wall elements, each wall element including a frame with vertical frame limbs and at least two panel plates covering the frame and defining an outside;

two frame connection coupling members, each of said frame connection coupling members being arranged in each case in a region extending outwardly of an extent of said vertical frame limbs of the respective connected two wall elements;

a connecting element coupling member, said two fame connection coupling members and said connecting element coupling members respectively having matching operating surfaces, providing clamping engagement behind the operating surfaces, each of said frame connection coupling members being fitted on a vertical outer edge of the of a respective one of the wall elements, the two wall elements being connected to one another by engaging matching operating surfaces of said Connecting element coupling member with each of said two frame connection coupling members; and releasable securing elements, which secure a position of said connecting element coupling members in a fixed state in a positive locking manner, said releasable securing elements being provide as parts separate and distinct from said connecting element coupling members.

19. The partitions according to claim 18, wherein said securing elements are constructed as spring mounted locking bar elements.

20. The partitions according to claim 18, wherein said connecting element coupling member coupling member engaged with each of said two frame connection coupling members defines a horizontal spacing between at least two edges of the wall elements.

21. The partitions according to claim 18, wherein said securing elements are constructed as bolt elements, which engage through matching openings in said connecting element coupling members and in a connected state.

22. A method for constructing partitions, comprising the steps of providing at least one connecting element coupling member pre-fitted to a frame connection on one vertical side of a first wall element;

providing at least one connecting element coupling member prefitted to a frame connection on one vertical side of a second wall element;

suspending said first wall element with the pre-fitted connecting element coupling members in the frame connection coupling members on a vertical side without pre-fitted connecting element coupling members of said second wall element; and subsequently fitting further connecting element coupling members for providing the partition.

* * * * *